166-66 SR

2/15/83 XR 4,373,581

United States Patent [19]

Toellner

[11] 4,373,581

[45] Feb. 15, 1983

[54] APPARATUS AND METHOD FOR RADIO FREQUENCY HEATING OF HYDROCARBONACEOUS EARTH FORMATIONS INCLUDING AN IMPEDANCE MATCHING TECHNIQUE

[75] Inventor: Robert L. Toellner, Duncan, Okla.

[73] Assignee: Halliburton Company, Duncan, Okla.

[21] Appl. No.: 226,308

[22] Filed: Jan. 19, 1981

[51] Int. Cl.[3] ..... E21B 43/24; E21B 47/00; E21B 43/12

[52] U.S. Cl. ..... 166/53; 166/60; 166/66; 166/248; 166/250; 333/17 M; 333/32

[58] Field of Search ..... 166/50, 60, 65 R, 66, 166/248, 250, 302, 53; 219/10.41, 10.55, 10.81; 333/17 M, 32

[56] References Cited

U.S. PATENT DOCUMENTS

| | | | |
|---|---|---|---|
| 2,084,740 | 6/1937 | McKesson | 333/32 X |
| 2,543,973 | 3/1951 | Jensen | 333/32 X |
| 3,132,313 | 3/1954 | Alford | 333/32 X |
| 3,264,584 | 8/1966 | Edwards | 333/32 X |
| 3,343,888 | 9/1967 | Boykin | 333/32 X |
| 3,718,873 | 2/1973 | Garber | 333/32 X |
| 3,778,731 | 12/1973 | Oomen | 333/17 M |
| 4,135,579 | 1/1979 | Rowland et al. | 166/248 |
| 4,193,451 | 3/1980 | Dauphine | 166/248 |
| 4,301,865 | 11/1981 | Kasevich et al. | 166/248 |

*Primary Examiner*—Stephen J. Novosad
*Assistant Examiner*—George A. Suchfield
*Attorney, Agent, or Firm*—William J. Beard

[57] ABSTRACT

The disclosure relates to a technique for radio frequency heating of hydrocarbonaceous earth formations in which a high power radio frequency transmitter is impedance matched to a transmission line including a plurality of conductors at least partially embedded in the formation to be heated. The impedance matching may be effected by a "T" network having three variable reactances. In accordance with the teachings of the present invention, continuous variations of impedance, of the type encountered during the heating of the formation, may be matched in unambiguously defined Smith chart regions by varying two of the three reactances to minimize reflected power from the transmission line.

9 Claims, 6 Drawing Figures

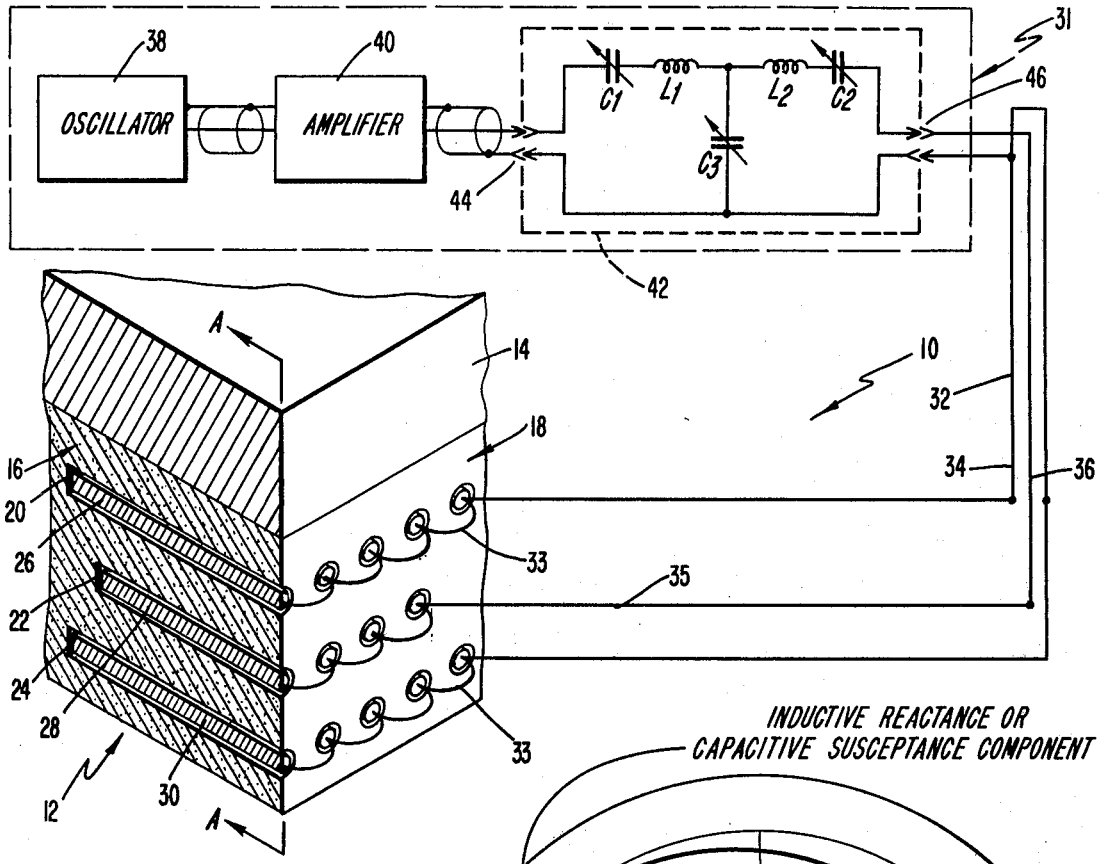
Fig. 1
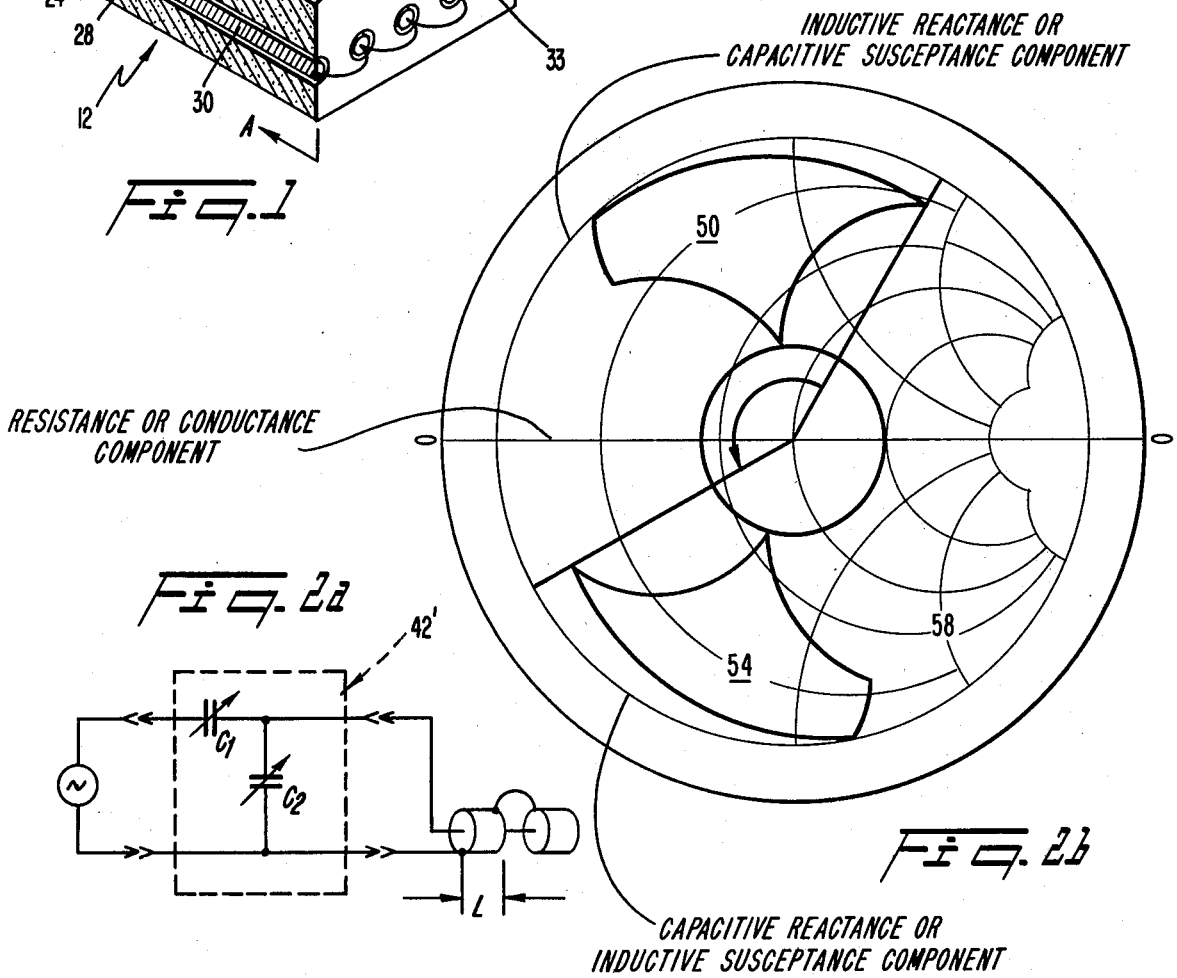
Fig. 2b
Fig. 2a

APPARATUS AND METHOD FOR RADIO FREQUENCY HEATING OF HYDROCARBONACEOUS EARTH FORMATIONS INCLUDING AN IMPEDANCE MATCHING TECHNIQUE

BACKGROUND OF THE INVENTION

This invention relates to a method for the recovery of useful products such as oil and gas from hydrocarbon bearing deposits such as oil shale or tar sand by the application of radio frequency energy to heat the deposits. Such techniques are generally classified by the U.S. Patent and Trademark Office in class 166, subclass 248. More specifically, the invention relates to a method and apparatus in which a high power radio frequency transmitter is electrically matched to the varying impedances encountered when conductor arrays, inserted in an earth formation, are employed to efficiently couple radio frequency energy into an earth formation to heat the earth formation.

This country's reserves of oil shale and tar sand contain enough hydrocarbonaceous material to supply this nation's liquid fuel needs for many years. A number of proposals have been made for processing and recovering hydrocarbonaceous deposits, which are broadly classed as "in situ" methods. Such methods may involve underground heating or retorting of material in place, with little or no mining or disposal of solid material in the spent formation. Useful constituents of the formation including liquids of reduced viscosity may be drawn to the surface by a pumping system or forced to the surface by the technique of injecting another substance into the formation.

It has been proposed that relatively large volumes of hydrocarbonaceous formations can be heated in situ using radio frequency energy. These proposals are exemplified by the disclosures of the following patents: U.S. Pat. No. 4,144,935 to Bridges et al., now reissue application Ser. No. 118,957 filed Feb. 2, 1980, which is now U.S. Pat. No. Re. 30,738; U.S. Pat. No. 4,140,180 to Bridges et al., U.S. Pat. No. 4,135,579 to Rowland et al.; U.S. Pat. No. 4,140,179 to Kasevich et al.; and U.S. Pat. No. 4,193,451 to Dauphine.

Embodiments disclosed in these patents call for the heating of oil shale or tar sand with one or a plurality of conductors at least partially embedded in the formation. Embodiments disclosed by Bridges et al. enclose or bound a volume of a formation in an electrical sense with arrays of spaced conductors. One such array consists of three spaced rows of conductors which form the so-called "triplate-type" of transmission line structure similar to that shown in FIG. 1 of this application.

The measurement of electrical and thermal properties of solid hydrocarbonaceous material have been made in the laboratory. See, Joel DuBow, "Electrical and Thermal Properties of Oil Shale of Interest to in-situ Shale Oil Extraction," N.T.I.S. Publication No. PB-267 136 (1977). Variations in impedance of conductor arrays inserted in an earth formation have been predicted. These variations suggest the need for impedance matching techniques to permit maximum power to be transferred to the formation and prevent overloading of the radio frequency transmitter used to provide the power.

Two matching techniques have been proposed by others working in the field. First, the above-cited patent to Dauphine states that the particular impedance of the radiating structure (conductors imbedded in the formation) can be matched by changing taps on a transformer and/or by adding reactive impedances as appropriate to the output of the transformer in accordance with well-known practice. However, continuous matching of a variable load impedance may be unobtainable with the transformer proposed by Dauphine unless a very large number of transformer taps are available. At radio frequencies, typically such transformers have a small number of turns (for example, 10) and the number of taps which can be provided are limited by the number of turns.

A second matching technique was used in a field test in which applicant participated prior to his making of the invention herein described. The field test involved the use of an embodiment of the Bridges et al tri-plate type of transmission line with an "L" matching network such as that shown in FIG. 2*a*, and described in greater detail below. This network was found to be ineffective to correct for some variations in the load impedance encountered as the formation was heated. An additional correction of impedance mismatch was provided in the field test by changing the effective length of the transmission line to which the network was connected. However, such changes required that the transmitter be shut down and that mechanical changes in the line be made, (e.g., additions or subtractions to the line length), resulting in delays in the application of heat during which the formation could cool. Nevertheless, impedances in certain Smith chart regions could not be matched with the field test apparatus. (This matter is discussed in greater detail in connection with FIG. 2*b*, below.)

Accordingly, it is a feature of the present invention that impedance changes encountered in radio frequency heating of an earth formation with embedded conductor arrays be compensated without electrical disconnection or shut down of the transmitter coupled to the conductor arrays.

It is another feature of the present invention to provide an impedance matching network which is effective in Smith chart regions corresponding to impedances encountered during the radio frequency heating of an earth formation with a transmission line including conductors at least partially embedded in the formation.

It is another feature of the matching network of the present invention that impedance matching, employing the adjustment of continuously variable electrical elements, be provided in response to variations in the load impedance encountered during the radio-frequency heating of an earth formation with a transmission line including conductors at least partially embedded in the formation.

It is another feature of the matching network of the present invention that impedance matching adjustments be made in an impedance matching network in accordance with simple and unambiguous operating procedures.

These and other features of the invention will become apparent from the claims, and from the following description when read in conjunction with the accompanying drawings.

SUMMARY OF THE INVENTION

Applicant has devised a technique for matching a high powered radio frequency transmitter to the widely varying impedances encountered during the radio frequency heating of an earth formation within a transmission line including conductors at least partially embedded in the earth formation.

The invention includes an impedance matching network having a first port connected to a high power radio frequency transmitter and a second port connected to the transmission line, which includes the conductors at least partially embedded in a hydrocarbonaceous earth formation to be heated. The matching network is configured in the form of a "T" network having first and second variable reactances connected in series to form an upper leg of the "T" network. A third variable reactance is connected in shunt between the first and second variable reactances to form the central leg of the "T" network. The reactance ranges of the variable reactances are selected to define Smith chart regions in which only two of the three variable reactances need be adjusted from their minimum or maximum settings in order to match variations in the impedance of the transmission line encountered during the heating of the hydrocarbonaceous formation.

Advantageously, the first variable reactance may include a first independently variable capacitor. Likewise the second and third variable reactances may include second and third independently variable capacitors, respectively. In addition the first variable reactance means and the second variable reactance means may each include a fixed inductor connected in series with the variable capacitors in the upper leg of the "T" network. In this embodiment the third variable capacitor is connected as a shunt between the first and second fixed inductors.

The values of the first variable capacitor and the first fixed inductor may be selected so that the series combination has an impedance, $jX_1$ which is inductive. Likewise the values of the second variable capacitor and second fixed inductor may be selected so that the series combination thereof has an impedance, $jX_2$, which is inductive. Examples of the ranges of reactances to which the variable reactances may be adjusted are given below.

A matching network, such as the aforementioned "T" network, may be employed in a method of matching the high power radio frequency transmitter to the variable impedance load presented by the transmission line. In the practice of this method a variation from a predetermined value of power reflected from the variable impedance load is detected. Advantageously this detection may be performed with a directionally coupled power meter located between the transmitter and the input port of the matching network. The apparatus may further include detection circuits for indicating the reactances of each of the three variable reactances when the impedance of the transmission line is matched. When the system drifts from a matched condition the drift will be detected by the reflected power detector. The apparatus is designed to respond to such drifting and to restore the system to a matched state. In order to accomplish this a selection and control network is provided for selecting two of the three variable reactances for subsequent adjustment responsive to the detected reactances of all of the variable reactances for subsequent adjustment responsive to the detected reactances of all three of the variable reactance devices in their formerly matched state. The network also controls the adjustment of the selected two variable capacitors responsive to detected variations in the power reflected by the transmission line.

The method of restoring the system to a matched condition will now be described in greater detail. At the beginning of a heating cycle the impedance of the transmission line may be determined in a conventional manner such as with a radio frequency bridge and the variable reactances set in response to this initial reading so that the detected reflected power is at a minimum or zero. As heating of the formation occurs and the apparatus drifts from a matched condition, one of the variable reactances is selected for adjustment until the reflected power reaches a minimum. Then a second one of the variable reactances is selected for adjustment until the reflected power reaches a minimum. The selection of the two variable reactances to be adjusted is made in response to the impedance of the load as determined from the values of the variable reactances at the time the matching was last achieved. The adjustments of these two selected variable reactances are alternately repeated until the reflected power approaches a predetermined value or zero to within a predetermined tolerance.

BRIEF DESCRIPTION OF THE DRAWINGS

FIG. 1 is a schematic diagram and pictorial view in cross-section illustrating an embodiment of the present invention for matching a transmission line including conductors at least partially embedded in an earth formation.

FIG. 2*a* is a schematic diagram of a matching network employed in a field test.

FIG. 2*b* is a Smith chart with legends, illustrating the constraints imposed on impedance matching with the prior art network of FIG. 2*a*.

DETAILED DESCRIPTION

Figure 3:
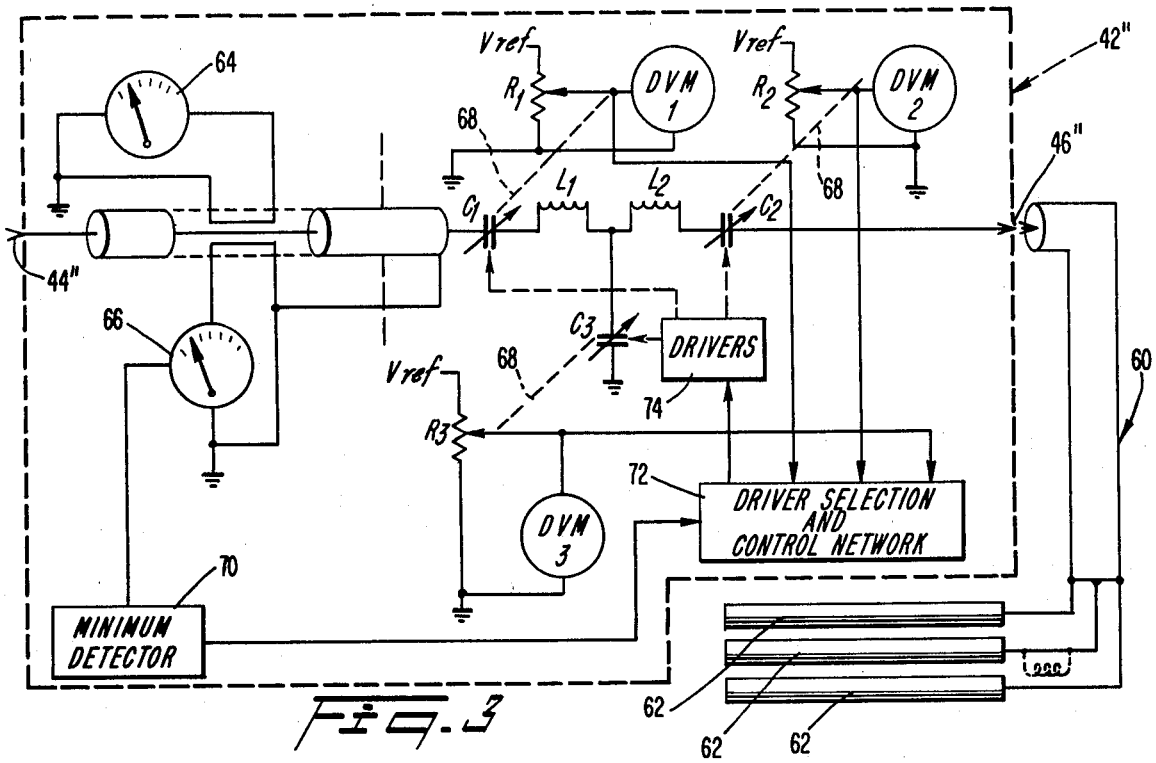
FIG. 3 is a schematic diagram of an embodiment of the present invention illustrating a technique for determining the impedance of an earth formation and matching that impedance to the impedance of a transmitter.

Referring first to FIG. 1, a device for applying radio frequency energy to a hydrocarbonaceous formation is denoted generally by the numeral 10. The hydrocarbonaceous formation 12, to be heated, may be situated between a barren overburden 14 and a barren substratum 16. The hydrocarbonaceous formation 12 may be oil shale and, advantageously, a stratum of oil shale such as that known as the "Mahogany" zone, which is characterized by a high concentration of kerogen per unit volume. Access to the hydrocarbonaceous bed 12 may be obtained through a face 18 of the formation. The face 18 may be the surface of a mined or drilled access shaft or the surface of a natural bed outcropping. Alternatively, access may be obtained to a subsurface hydrocarbonaceous bed by means of vertical boreholes drilled from the surface.

FIG. 1 includes a sectional view taken along the plane A—A and shows the location of rows of bore holes 20, 22, and 24. Conductors 26, 28 and 30 may be inserted in the boreholes to provide conductor arrays for effecting the heating of the hydrocarbonaceous formation 12.

A high power radio frequency generator 31 is provided to apply an electrical signal to the conductors 26, 28 and 30 via a coaxial transmission line 32. The upper conductors 26 and lower conductors 30 may be connected to a grounded shield 34 of the coaxial transmission line 32 by strap connections 33. The central conductors 28 may be connected to an inner conductor 36 of the coaxial transmission line 32 by strap connections 35. In a preferred embodiment of the present invention the coaxial transmission line 32 may be a 50 ohm impedance transmission line consisting of sections of copper tubing filled with non-conductive gas and containing a copper coaxial inner conductor.

The radio frequency signal generator 31 may include a high powered radio frequency transmitter having the capacity to deliver a radio frequency signal having a power level greater than 100 kilowatts and preferably in the megawatt range. In a preferred embodiment of the present invention, the signal generator 31 may consist of a radio frequency oscillator 38, the output of which is applied to a high power amplifier 40. An output signal from the amplifier 40 is coupled to a matching network 42. The matching network 42 is provided to match the amplifier to the transmission line structure. In this embodiment the transmission line structure includes the coaxial transmission line 32, the strap connections 33 and 35, the conductors 26, 28 and 30, and a dielectric medium consisting of portions of the formation adjacent the conductors 26, 28 and 30. The transmission line structure includes portions of the hydrocarbonaceous earth formation, which function as a lossy dielectric whose propagation constant changes as the formation is heated. The matching network 42 is designed to present an approximately constant impedance to the output of the amplifier in spite of variations in the impedance of the transmission line structure during heating of the formation.

The matching network 42 of FIG. 1 is configured as a "T" network. The matching network 42 may have a first or input port 44 connected to the amplifier 40 and a second port or output 46 connected to the transmission line structure. An upper leg of the "T" network may include a first and a second variable reactance connected in series between the first port 44 and the second port 46. A third variable reactance may be provided in shunt between the first and second variable reactances to form the central leg of the "T" network. Advantageously, the first variable reactance means may include the series combination of a first variable vacuum capacitor $C_1$ and a first fixed inductor $L_1$. The second variable reactance means may, likewise, include the series combination of a second fixed inductor $L_2$ and second variable vacuum capacitor $C_2$. The variable shunt reactance may consist of a third variable vacuum capacitor $C_3$.

It will be readily apparent that the above disclosed matching network includes no variable inductors. In the high current, high power environment of radio frequency heating devices for large blocks of earth formations, the absence of variable inductors obviates the need for the high current sliding contacts. Nevertheless, the variable vacuum capacitors used provide the capacity for continuous variation of the reactances in the matching network. Finally, the variable vacuum capacitors may conveniently be water cooled to prevent overheating when the system is driven at high power levels. In this connection the present apparatus may be contrasted with the variable inductor matching network disclosed by Oomen in U.S. Pat. No. 3,778,731.

For purposes of contrast an impedance matching network employed in the above-mentioned field tests will now be discussed in connection with FIGS. 2*a* and 2*b*. The matching network 42' of FIG. 2*a* comprises an L network having a variable series capacitor $C_1$ and variable shunt capacitor $C_2$. In the field test the following design parameters were selected to match a 50 ohm load:

$$-195 < jX_1 < -17$$
$$-165 < jX_2 < -24,$$

Where $jX_1$ is the capacitative reactance of $C_1$ in ohms and $jX_2$ is the capacitative reactance of $C_2$ in ohms. The region 50 (ranges of impedances) which can be matched by the network of FIG. 2*a* are graphed on the Smith chart of FIG. 2*b*. As will be apparent from FIG. 2*b* there are areas on the Smith chart representing possible load impedances which do not fall within region 50 and which cannot, therefore, be matched using only the L network of FIG. 2*a*. In the field test, a correction for this lack of coverage was devised which calls for additions to the effective length of the transmission line structure. The additional length of transmission line is designated by the numeral 52 in FIG. 2*a*. Its length is represented by the letter "L." The effect of adding the additional length 52 to the transmission line is to rotate the region 50 which can be matched to a new position 54 on the Smith chart. The amount of rotation on the Smith chart is given by the equation:

$$(2L/\lambda)\cdot 360^\circ$$

Where $\lambda$ is the wave length of the radio frequency signal employed. Thus, by addition of various lengths of transmission line to the system the area 50 can be rotated about the Smith chart so that it sweeps out an area defined as an annulus by concentric circles 56 and 58.

As noted above in the background of the invention section of this application, the matching technique discussed in connection with FIGS. 2*a* and 2*b* suffers from the disadvantage that it requires a shut down of the system in order to connect and disconnect various lengths of coaxial transmission line into the system to effect the appropriate impedance matching. Aside from the inconvenience of having to provide various lengths of additional transmission line and the difficulties in making the connections, the system is incapable of making a continuous, uninterrupted impedance matches since heating must stop in order to change the line length during which time the formation may cool and the impedance of the transmission line structure may change further.

FIG. 3 is a schematic diagram of a preferred embodiment of the present invention illustrating a technique for determining the impedance of a transmission line structure and matching that impedance to the impedance of a high power transmitter. The apparatus includes a matching network 42'' connected to the transmission line structure 60. The transmission line structure includes a plurality of conductors 62 at least partially embedded in an earth formation. The matching network 42'' has a first or input port 44'' which may be connected to a high power transmitter. A second or output port 46'' is connected to the transmission line 60.

A forward power meter 64 may be provided to detect the amount of power being imposed on the matching network and transmission line structure. A reverse power meter 66 is employed to sense power reflected back from the matching network and transmission line structure. Detected variations in the reflected power may be employed to adjust the matching network as will be discussed in greater detail below.

The matching network includes a T network consisting of variable capacitors $C_1$, $C_2$ and $C_3$ and fixed inductors $L_1$ and $L_2$. An input leg of the T network consists of the variable capacitor $C_1$ and the fixed inductor $L_1$ connected in series; the output leg of the T network consists of the fixed inductor $L_2$ and the variable capacitor $C_2$ connected in series; and $C_3$ is employed as a variable shunt capacitor connected between said input and output legs.

In order to determine the impedance of the transmission line structure 60 the effective capacitances of the variable capacitors $C_1$, $C_2$ and $C_3$ are determined. In the embodiment shown this may be accomplished by mechanically coupling the variable capacitors $C_1$, $C_2$ and $C_3$ to variable resistors $R_1$, $R_2$ and $R_3$, respectively. This mechanical coupling is indicated by dotted lines 68. A reference voltage Vref may be applied across the variable resistors $R_1$, $R_2$ and $R_3$. It will be readily understood that a voltage will appear across the wipers of the variable resistors $R_1$, $R_2$ and $R_3$ which is related in value to the capacitances of the variable capacitors $C_1$, $C_2$ and $C_3$. These voltages may be measured by digital volt meters (DVM 1, DVM 2 and DVM 3) and converted to values representive of the capacitative reactances of the legs of the network.

The embodiment of FIG. 3 may be employed to provide continuous, automatic impedance matching in accordance with the method of the present invention. An initial matching of the transmitter to the transmission line 60 may be achieved either by measuring the impedance of the transmission line 60 in a conventional manner as with a radio frequency bridge and setting the variable capacitors $C_1$, $C_2$ and $C_3$ to setting corresponding to this impedance or by varying the three variable capacitors until a match is achieved. Once the initial match has been achieved, it becomes necessary only to vary two of the three variable capacitors while holding the other at a minimum or maximum in order to compensate for changes in load impedance. The apparatus of FIG. 3 may automatically select the two variable capacitors to be adjusted and control their adjustment to achieve matching. This automatic matching circuitry includes a minimum detector 70 which receives an output signal from the reverse power meter 66 and detects variations from minimum reflected power. An output signal from the minimum detector 70 may be applied to a driver selection and control network 72 which controls the selection and adjustment of capacitors $C_1$, $C_2$and $C_3$. This selection and adjustment is done in accordance with the technique described below in connection with FIG. 5. An output signal from the driver selection and control network 72 is applied to drivers 74 which may be servomechanical adjustment devices for the capacitors $C_1$, $C_2$ and $C_3$. Values obtained from digital volt meters 1, 2 and 3 may periodically be read as matching is achieved, from which values the impedance of the transmission line structure 60 may be determined.

Figure 4:
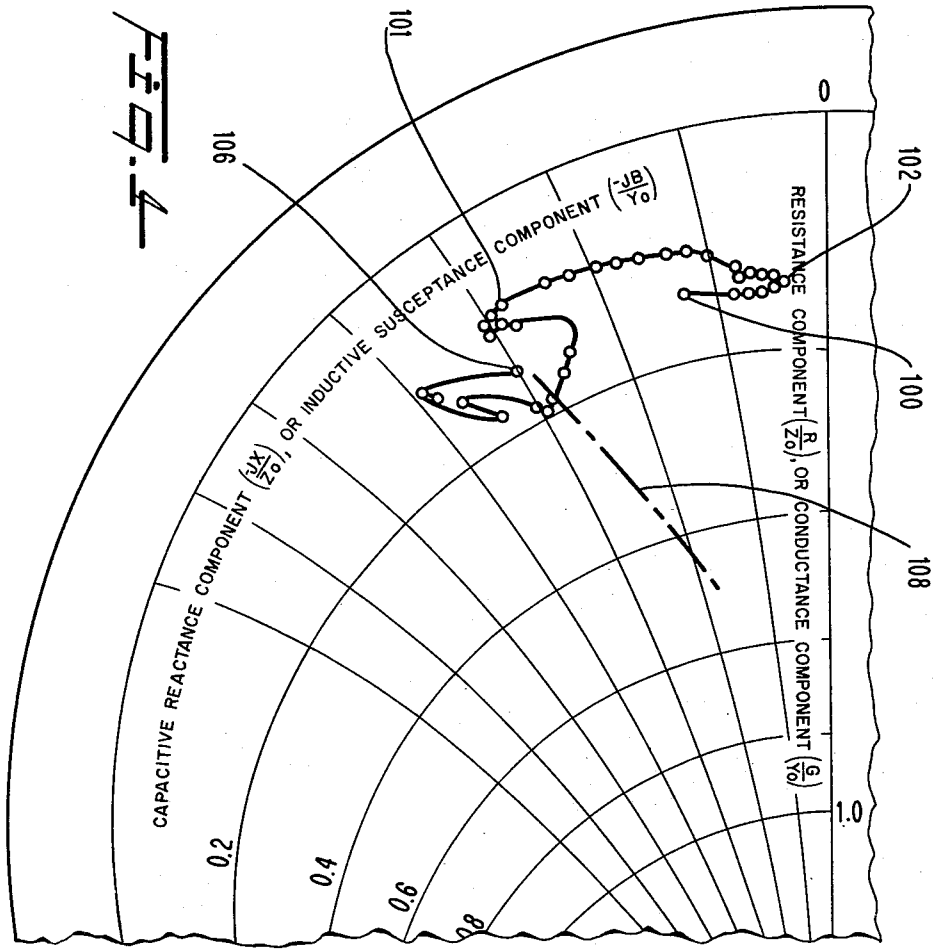
FIG. 4 is a Smith chart illustrating continuously varying impedance experimentally observed during the radio frequency heating of an earth formation.

Experimental data obtained using the circuit of FIG. 2 suggests that the impedance of a hydrocarbonaceous formation and conductor arrays might vary in the fashion indicated in FIG. 4. The data of FIG. 4 was obtained from measurement of the series and shunt voltage of capacitors $C_1$ and $C_2$ in FIG. 2 and the resulting impedance value corrected for the coaxial transmission line length and for the parasitic inductance of the strap connections such as those shown in FIG. 1 and identified with the numerals 33 and 35.

The data points shown in FIG. 4 show a roughly continuous variation in the impedance of the formation and conductor arrays over a period of about four days. The first reading 100 represents the impedance of the formation and conductors arrays at the beginning of the heating cycle. As will be observed the inductive component of the impedance decreases to point 102. This impedance decrease may be reproducible and may represent the driving off of free water from the formation. Subsequently, the inductive component of the impedance increases to reading 104. This increase may represent the driving off of bound water from the formation. At about reading 104 the production of kerogen was observed to begin. Somewhat more radical changes in impedance were observed toward the end of the heating cycle as shown by the more abrupt changes in impedance from reading 104 to reading 106. Later runs exhibited a change of impedance toward the center of the chart indicated by line 108. Impedances along this line were particularly difficult to match with the apparatus of FIG. *2a*. It is believed that the variations in impedance plotted in FIG. 4 can be more effectively and conveniently matched with the method and apparatus of the present invention.

Figure 5:
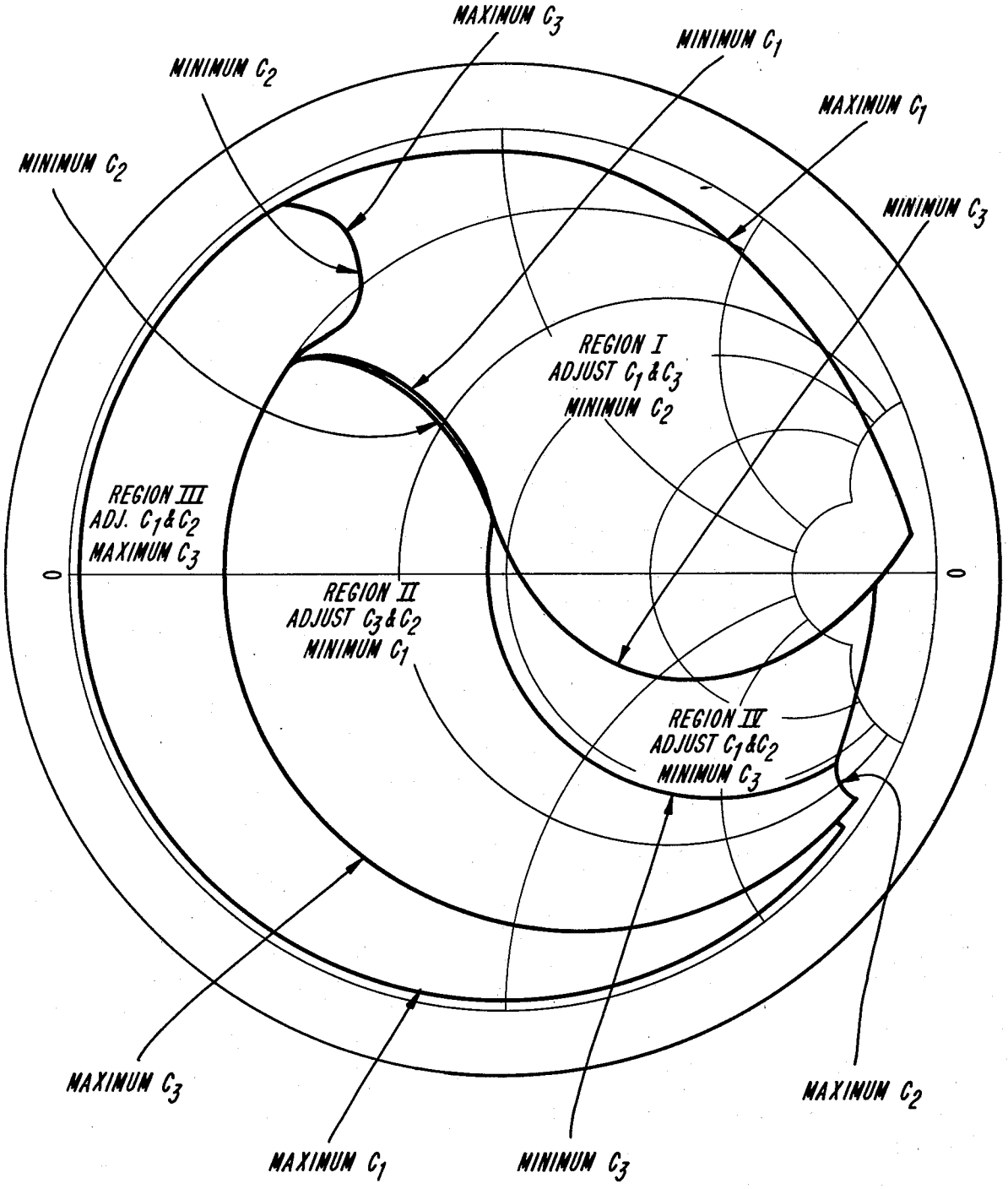
FIG. 5 is a Smith chart with legends illustrating load reactance values which may be matched by adjustment of selected pairs of the variable capacitors shown in FIG. 3.

FIG. 5 is a Smith chart with legends illustrating load impedance values which may be matched by adjustment of selected pairs of the variable capacitors shown in FIGS. 1 and 3. The Smith chart of FIG. 5 is prepared using the following design constraints for the components of the T network:

$0 < jX_1 < 200$ $0 < jX_2 < 200$ $-200 < jX_3 < -25,$

Where $jX_1$ is the reactance of the series combination of $C_1$ and $L_1$, $jX_2$ is the reactance of the series combination of fixed inductor $L_2$ and variable capacitor $C_2$, and $jX_3$ is the reactance of the variable capacitor $C_3$, all in ohms at the working frequency. It will be noted that the series reactance of the first variable capacitor and first mixed inductance is variable from approximately zero to a predetermined inductive reactance. Likewise, the series reactance of the second variable capacitor $C_2$ and the second fixed inductor $L_2$ has a reactance which is variable from approximately zero to a predetermined inductive reactance. The reactance of the third variable capacitor is always capacitive within the range specified.

It is intended that matching be achieved with the apparatus of FIG. 3 in regions 1, 2, 3 and 4 of the Smith chart of FIG. 5. It is believed that the impedances encountered in the heating of hydrocarbonaceous formations will fall within these regions.

As set out in the legends of FIG. 5, matching can be achieved within a particular region by setting one of the capacitors to a minimum or maximum value and making the fine adjustments with the remaining two capacitors. The capacitor selection for each region is given by the following Table:

Region I—adjust $C_1$, and $C_3$; set $C_2$ to its minimum

Region II—adjust $C_3$ and $C_2$; set $C_1$ to its minimum

Region III—adjust $C_1$ and $C_2$; set $C_3$ to its maximum

Region IV—adjust $C_1$ and $C_2$; set $C_3$ to its minimum

In operation for matching within a first identified region, the designated two capacitors $C_x$ and $C_y$, are selected for adjustment and the remaining capacitor $C_z$ is set to the minimum or maximum value indicated in the Table. One of the selected capacitors is then adjusted until a minimum in the reflected power is detected. The other of the selected capacitors is adjusted until a minimum in reflected power is detected. The phrase "minimum reflected power" is intended to indicate the transition point between falling and rising values of reflected power. The two capacitors may be alternately adjusted until the reflected power approximates zero within a predetermined tolerance dictated by the degree of matching necessary to prevent overdriving of the transmitter and to prevent excessive loss of energy in the coupling of the transmitter to the formation.

If one of the selected capacitors, for example, $C_x$, is adjusted through its entire range, without a minimum in reflected being detected, a change in region is indicated. Further matching would then be attempted on the basis of the constraints for a second region adjacent the first identified region. The new region in which matching will be attempted may be identified as follows. The new region will have a common boundary with the old region defined by a line on the Smith chart which corresponds to the loci of impedance values which would result from the following constraints:

(1) $C_z$ set at its minimum or maximum as required the first identified region;

(2) $C_x$ set at the value at which the reflected power is lowest; and (3) $C_y$ varied through its range.

The technique of achieving impedance matching of the present invention will now be discussed with reference to an example. If an initial impedance matching has been achieved in region II, the following steps would be employed to compensate for continuous drift observed in the impedance of the transmission line structure. As drifting occurs an increase in the reflected power would be detected by the reverse power meter 60 and minimum detector 70 shown in FIG. 3. The driver selection and control network 72 would select two capacitors to be adjusted in response to the variation of the reverse power from its minimum. Using stored information analogous to the information contained in FIG. 5 and the above Table, the driver selection and control network would maintain $C_1$ at its minimum. It would then adjust one of the remaining capacitors, $C_2$ or $C_3$, to minimize the reflected power detected by the reverse power meter 66. Once this had been accomplished the driver selection and control network 72 would adjust the other of the selected variable capacitors (i.e., whichever one of $C_1$ or $C_2$ was not selected in the previous step) to minimize the reflected power from the load. The adjustments of these two capacitors would be alternately repeated until the reflected power appropriates zero within a predetermined tolerance.

In the event that the adjustment of a selected one of the variable capacitors did not reach a minimum when adjusted through its entire range, the driver selection and control network would select an adjacent region in which to achieve matching and apply the constraints particular to that region as set out in the legends of FIG. 5 and the above Table.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An impedance matching network having a first port connected to a high power radio frequency transmitter and a second port connected to a transmission line including conductors at least partially embedded in a hydrocarbonaceous earth formation to be heated, comprising a first and a second variable reactance means, said first and second variable reactance means comprising respectively, first and second independently variable capacitors, connected in series to form an upper leg of a T network; and a third variable reactance means, said third variable reactance means comprising a third independently variable capacitor, in shunt between the first and second variable reactance means to form the central leg of a T network, wherein the impedance presented by said transmission line during the heating of the hydrocarbonaceous formation is matched by holding one of the variable reactances at its minimum or maximum and adjusting the other two variable reactance means.

2. The apparatus of claim 1 wherein said first variable reactance means further comprises a first fixed inductor connected in series with the first variable capacitor in the upper leg of the T network, and wherein said second variable reactance means further comprises a second fixed inductor connected in series with the second variable capacitor.

3. The apparatus of claim 2 wherein the series combination of the first variable capacitor and first fixed inductor has a reactance, $jX_1$, which is inductive; and wherein the series combination of the second variable capacitor and second fixed inductor has an impedance, $jX_2$, which is inductive.

4. The apparatus of claim 2 wherein the series combination of the first variable capacitor and first fixed inductor has a reactance, $jX_1$, which is variable from approximately zero to a predetermined inductive reactance; and wherein the series combination of the second variable capacitor and second fixed inductor has a reactance, $jX_2$, which is variable from approximately zero to a predetermined inductive reactance.

5. The apparatus of claim 4 wherein the reactances of the first, second and third variable reactance means are given by the equations:

$0 < jX_1 < 200$ $0 < jX_2 < 200$ $-200 < jX_3 < -25$

Where the values of the reactances are in ohms at the frequency of the transmitter and the output impedance of the transmitter 50 ohms.

6. The apparatus of claim 1 further comprising means coupled at the first port of the matching network, for detecting variations in the power reflected by said transmission line during the heating of the hydrocarbonaceous formation.

7. The apparatus of claim 6 further comprising means for detecting the reactances of each of the three variable reactance means when the impedance of the transmission line is matched.

8. The apparatus of claim 7 further comprising means for selecting two of the three variable capacitors for adjustment responsive to the detected reactances of the three variable reactance means and for controlling the adjustment of said two variable capacitors responsive to detected variations in the power reflected by said transmission line.

9. The apparatus of claim 7 further comprising means for determining the impedance of the transmission line when matched by the impedance matching network responsive to the indicated reactances of each of the three variable reactance means.

* * * * *